US006082228A

United States Patent [19]

Macor

[11] Patent Number: 6,082,228

[45] Date of Patent: Jul. 4, 2000

[54] UNI-DIRECTIONAL OPEN END WRENCH

[75] Inventor: Richard J. Macor, Warren County, N.J.

[73] Assignee: Proprietary Technologies, Inc.

[21] Appl. No.: 09/208,372

[22] Filed: Dec. 9, 1998

Related U.S. Application Data

[63] Continuation-in-part of application No. 29/094,076, Sep. 25, 1998, Pat. No. Des. 412,819.

[51] Int. Cl.[7] ..... B25B 13/08

[52] U.S. Cl. ..... 81/119; 81/186

[58] Field of Search ..... 81/119, 121.1, 81/125.1, 186, 426, 424.5

[56] References Cited

U.S. PATENT DOCUMENTS

| | | | |
|---|---|---|---|
| D. 357,618 | 4/1995 | Macor . | |
| 4,776,244 | 10/1988 | Olson et al. | 81/119 |
| 5,131,312 | 7/1992 | Macor . | |
| 5,582,083 | 12/1996 | Baker | 81/119 |
| 5,953,968 | 9/1999 | Macor . | |

*Primary Examiner*—D. S. Meislin

[57] ABSTRACT

An open end wrench head is described having four principle internal engaging surfaces arranged about an imaginary central axis with the first and second internal engaging surfaces positioned on a first jaw and the third and fourth internal engaging surfaces positioned on a second opposing jaw. The first and third internal engaging surfaces are substantially flat and parallel to the imaginary central axis. The second internal engaging surface diverges outward from the first internal engaging surface and fourth internal engaging surface diverges outward from the third internal engaging surface. When the present invention wrench head is turned in one direction it acts like a standard open end wrench, however, when the present invention wrench head is turned in the other direction or in a predetermined direction, two of the four internal engaging surfaces provide a substantial increase in surface-to-surface contact with the nut, bolt or fastener being turned, thereby increasing wrench strength and torque while reducing fastener deformation and wrench wear. The benefit of having a uni-directional increase in performance is that the total free play arc of wrench to fastener is kept to a minimum, and the flip-flop feature of the wrench in limited access situations is maintained.

10 Claims, 2 Drawing Sheets

UNI-DIRECTIONAL OPEN END WRENCH

REFERENCES TO RELATED APPLICATIONS

This application is a continuation-in-part of U.S. patent application Ser. No. 29/094,076 filed on Sep. 25, 1998, by the inventor herein, entitled OPEN END WRENCH HEAD, now U.S. Pat. No. D412,819.

FIELD OF THE INVENTION

The present invention relates to hand tools, particularly wrenches and most particularly open end type wrenches.

BACKGROUND OF THE INVENTION

An open end wrench is a wrench that has an open ended wrench head used to turn and control the rotation of bolts, nuts and various fasteners. Examples of open end wrenches include, but are not limited to, double open end, combination, flare nut, flex head etc. An open end wrench can access fasteners under certain limited-access conditions where a closed end or box wrench cannot, however, an open end wrench is much weaker by design than a box wrench. The weakness is associated with the inevitable jaw expansion of the wrench produced by the cam effect of fastener to wrench, under torque. This inherent weakness reduces torque capacity and promotes fastener deformation and wrench wear.

Subsequently, there have been numerous attempts to increase the strength and torque capacity of open end wrenches. The use of sharp teeth or serrations has been relatively effective on all but extremely hard fasteners, however, this technology sacrificed the fastener to gain additional torque by leaving bite or shred marks on the fastener. The use of inclined and arcuate driving surfaces has been effective at reducing the bite marks and fastener deformation, however, this technology has been generally less effective at increasing wrench strength and torque capacity. In addition, most prior attempts to improve the torque capacity of open end wrenches have consequently produced an increase in the total free play arc between wrench and fastener which applicant believes to be objectionable to most users.

SUMMARY OF THE INVENTION

The present invention involves a uni-directional, high torque, open end wrench head which when turned in a predetermined direction can provide a substantial increase in torque capacity while reducing fastener deformation and wrench wear.

The present invention more specifically involves an open end wrench head that includes four principle internal engaging surfaces arranged about an imaginary central axis and intersecting cross line with the first and second internal engaging surfaces positioned on a first jaw and the third and fourth internal engaging surfaces positioned on a second opposing jaw. The first internal engaging surface is substantially flat and parallel to the imaginary central axis and positioned closer to the open end of the wrench head than the second internal engaging surface. The second internal engaging surface diverges outward from the first internal engaging surface. Positioned on the second jaw which opposes the first jaw of the present invention wrench head, is the third and fourth internal engaging surfaces. The third internal engaging surface is substantially flat and parallel to the imaginary central axis and positioned farther away from the open end of the wrench head than the fourth internal engaging surface. The fourth internal engaging surface diverges outward from the third internal engaging surface. In all embodiments of the present invention, the imaginary central axis and imaginary cross line together form four imaginary quadrants, and, the second and fourth internal engaging surfaces are each positioned within separate, diagonally opposed quadrants. In some preferred embodiments, the present invention can have a fifth internal engaging surface positioned on the second jaw and closer to the open end of the wrench head than the fourth internal engaging surface. The fifth internal engaging surface provides the wrench with fastener tip engagement. It should be noted that the present invention wrench head comprises or includes four principle internal engaging surfaces and thus, can possibly have more than, or much more than four internal engaging surfaces.

The present invention has been developed recognizing the inevitable jaw expansion of a standard open end wrench under torque and the subsequent need to increase wrench strength and torque while reducing fastener deformation and wrench wear. In addition, the present invention has been developed recognizing the need to achieve such increases in performance without increasing the total free play arc between wrench and fastener or precluding wrench head offset ("flip-flop") capability.

Accordingly, it is an important objective of the present invention described above to significantly increase the strength and torque capacity of an open end wrench head without sacrificing the fastener by leaving bite marks, shred marks or otherwise deforming the fastener.

It is another objective of the present invention to achieve the improved performance without significantly increasing the total free play arc between wrench and fastener and while maintaining the ability to flip the wrench over or "flip-flop" the wrench in limited access situations.

It is another objective of the present invention that it be commercially viable, simple in design, and cost efficient to manufacture.

DETAILED DESCRIPTION OF THE DRAWINGS

Figure 1:
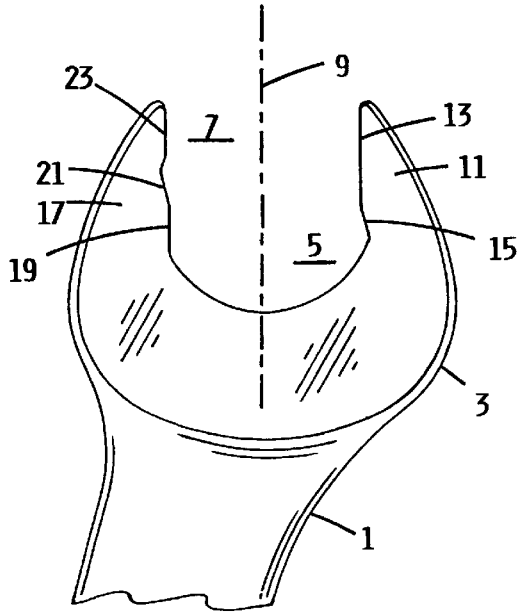
FIG. 1 shows a top plan, cut view of a present invention open end wrench.

Referring now to the drawings which are for the purpose of illustrating preferred embodiments of the present invention and not for the purpose of limiting same, FIG. 1 shows a top plan, cut view of a present invention open end wrench 1 having wrench head 3 with orifice 5 and open end 7. Wrench head 3 is a one piece wrench head without any moving parts. Wrench head 3 has four principle internal engaging surfaces arranged asymmetrically around an imaginary central axis and center line 9. The "principle" internal engaging surfaces shall be defined herein as the internal engaging surfaces of the wrench head which are of the greatest importance and which actually engage and interact with the fastener under torque, during normal operation. A first jaw 11 has the first internal engaging surface 13 and the second internal engaging surface 15. The first internal engaging surface 13 is substantially flat and parallel to imaginary central axis 9 and positioned closer to the open end 7 of wrench head 3 than the second internal engaging surface 15. The term "substantially flat" shall include all surfaces that are flat, regardless of texture. The surface can be flat and smooth, flat and textured or flat and grooved to intentionally increase friction between the wrench engaging surface and fastener. The second internal engaging surface 15 is substantially flat but diverges outward from the first internal engaging surface 13 and imaginary central axis 9. The second internal engaging surface 15 does not have to be flat, but could also be slightly arcuate. A second opposing jaw 17 has the third internal engaging surface 19 and the fourth internal engaging surface 21. The third internal engaging surface 19 is substantially flat and parallel to the imaginary central axis 9 and positioned farther away from the open end 7 of wrench head 3 than the fourth internal engaging surface 21. The fourth internal engaging surface 21 is substantially flat but diverges outward from the third internal engaging surface and imaginary central axis 9. The fourth internal engaging surface 21 does not have to be flat but could also be slightly arcuate.

In many preferred embodiments of the present invention the first internal engaging surface 13 is usually longer than the third internal engaging surface 19 which is usually longer than the second internal engaging surface 15.

In this embodiment of the present invention, there is also a fifth internal engaging surface 23 which provides the wrench head with fastener tip engagement when the wrench head can not be positioned flat on the surface surrounding a bolt head, nut or fastener. The fifth internal engaging surface 23 which is substantially parallel to the first internal engaging surface 13 can also provide a user with the ability to feel and confirm wrench size to fastener. It should be noted that the fifth internal engaging surface 23 is not considered a principle internal engaging surface as defined herein above, because the fifth internal engaging surface does not actually engage and interact with the fastener under torque, during normal operation.

Most standard type open end wrenches have two symmetrically opposing jaws with the internal engaging surfaces of one jaw symmetrically opposing the internal engaging surfaces of the other jaw. This provides the wrench with the same performance and features when turned in either direction, clockwise or counter-clockwise. The present invention wrench head, however, does not have symmetrically opposing jaws with the internal engaging surfaces of one jaw symmetrically opposing the internal engaging surfaces of the other jaw. In fact, it is a fundamental feature of the present invention wrench head that the four principle internal engaging surfaces asymmetrically oppose each other. More specifically and as shown in this figure, the first internal engaging surface 13 of the first jaw 11 asymmetrically opposes the fourth internal engaging surface 21 of the second jaw 17; and, the second internal engaging surface 15 of jaw 11 asymmetrically opposes the third internal engaging surface 19 of jaw 17. This asymmetrical opposition provides the wrench with its uni-directional performance capabilities which helps to keep the total free play arc between wrench and fastener to a minimum. In this figure, if wrench head 3 is turned in a counter-clockwise direction to loosen a hexagonal fastener not shown, internal engaging surfaces 13 and 19 would engage but not achieve a surface-to-surface contact with the fastener resulting in a performance similar to that of a standard type open end wrench. However, if wrench head 3 was turned in a clockwise direction to tighten a hexagonal fastener not shown, internal engaging surfaces 15 and 21 would engage and achieve a substantial surface-to-surface contact with the fastener. The result is a significant increase in wrench head strength and torque capacity, and a reduction in fastener deformation and wrench wear even if and when wrench jaws 11 and 17 open up and expand under torque.

Applicant is aware that there are prior art "ratcheting" type open end wrenches with internal engaging surfaces that are asymmetrically opposing other internal engaging surfaces, however, these wrenches are totally different in purpose, design and function to the present invention. The "ratcheting" type open wrenches are designed and formed to slip in one direction without catching or engaging with the fastener, consequently producing a limitless total free play arc between wrench and fastener. Additionally, this arrangement prevents the wrench head from being offset relative to the wrench handle so that a user can flip the wrench over or "flip-flop" the wrench to access fasteners in limited access situations. The "ratcheting" type open end wrench actually contradicts the purpose, design and function of the present invention.

Figure 2:
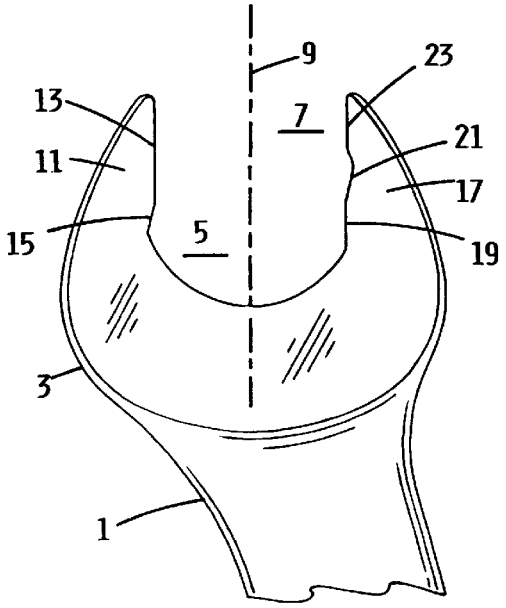
FIG. 2 shows a bottom, cut view of the present invention open end wrench shown in FIG. 1.

In FIG. 2 the wrench head shown in FIG. 1 is flipped over showing a bottom view thereof. In this figure, if wrench head 3 is turned in a clockwise direction to tighten a hexagonal fastener not shown, internal engaging surfaces 13 and 19 would engage but not achieve a surface-to-surface contact with the fastener resulting in a performance similar to that of a standard type open end wrench. However, if wrench head 3 was turned in a counter-clockwise direction to loosen the fastener not shown, internal engaging surfaces 15 and 21 would engage and achieve a substantial surface-to-surface contact with the fastener. The result is a significant increase in wrench head strength and torque capacity, and a reduction in fastener deformation and wrench wear even if and when wrench jaws 11 and 17 open up and expand under torque.

Figure 3:
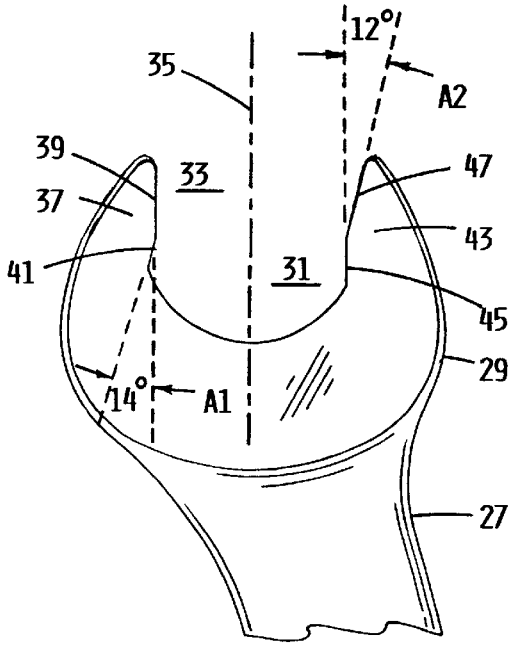
FIG. 3 shows a top plan, cut view of another present invention open end wrench.

FIG. 3 shows a top plan, cut view of another present invention open end wrench 27 having wrench head 29 with orifice 31 and open end 33. Wrench head 29 is a one piece wrench head without any moving parts. Wrench head 29 has four principle internal engaging surfaces arranged asymmetrically around an imaginary central axis and center line 35. Again, the "principle" internal engaging surfaces are the internal engaging surfaces of the wrench head which are of the greatest importance and which actually engage and interact with the fastener under torque, during normal operation. A first jaw 37 has the first internal engaging surface 39 and the second internal engaging surface 41. The first internal engaging surface 39 is substantially flat and parallel to imaginary central axis 35 and positioned closer to the open end 33 of wrench head 29 than the second internal engaging surface 41. The second internal engaging surface 41 is substantially flat but diverges outward from the first internal engaging surface 39 and imaginary central axis 35 at an angle A1 which is about 14 degrees. In preferred embodiments of the present invention, the second internal engaging surface 41 diverges outward from the first internal engaging surface 39 at an angle within the range of 3 through 18 degrees. The angle could be slightly more or less but is preferably within that range. The second internal engaging surface 41 does not have to be flat, but could also be slightly arcuate. A second opposing jaw 43 has the third internal engaging surface 45 and the fourth internal engaging surface 47. The third internal engaging surface 45 is substantially flat and parallel to the imaginary central axis 35 and positioned farther away from the open end 33 of wrench head 29 than the fourth internal engaging surface 47. The fourth internal engaging surface 47 is substantially flat but diverges outward from the third internal engaging surface 45 and imaginary central axis 35 at an angle A2 which is about 12 degrees. In preferred embodiments of the present invention, the fourth internal engaging surface 47 diverges outward from the third internal engaging surface 45 at an angle within the range of 3 through 18 degrees. The angle could be slightly more or less but is preferably within that range. The fourth internal engaging surface 47 does not have to be flat, but could also be slightly arcuate.

In many preferred embodiments of the present invention the first internal engaging surface 39 is longer than the third internal engaging surface 45 which is longer than the second internal engaging surface 41.

Figure 4:
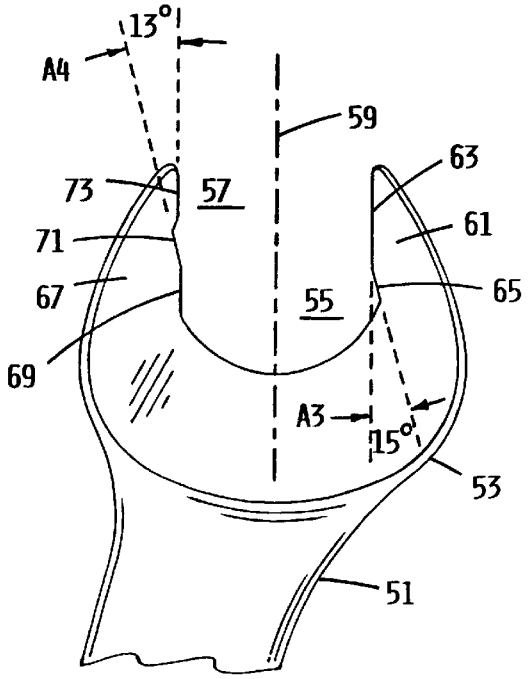
FIG. 4 shows a top plan, cut view of another present invention open end wrench.

FIG. 4 shows a top plan, cut view of another present invention open end wrench 51 having wrench head 53 with orifice 55 and open end 57. Wrench head 53 is a one piece wrench head without any moving parts. Wrench head 53 has four principle internal engaging surfaces arranged asymmetrically around an imaginary central axis and center line 59. Again, the "principle" internal engaging surfaces are the internal engaging surfaces of the wrench head which are of the greatest importance and which actually engage and interact with the fastener under torque, during normal operation. A first jaw 61 has the first internal engaging surface 63 and the second internal engaging surface 65. The first internal engaging surface is substantially flat and parallel to imaginary central axis 59. The second internal engaging surface 65 is substantially flat but diverges outward from the first internal engaging surface 63 and imaginary central axis 59 at an angle A3 which is about 15 degrees. In preferred embodiments of the present invention, the second internal engaging surface 65 diverges outward from the first internal engaging surface 63 at an angle within the range of 3 through 18 degrees. The angle could be slightly more or less but is preferably within that range. The second internal engaging surface 65 does not have to be flat, but could also be slightly arcuate. A second opposing jaw 67 has the third internal engaging surface 69 and the fourth internal engaging surface 71. The third internal engaging surface 69 is substantially flat and parallel to the imaginary central axis 59. The fourth internal engaging surface 71 is substantially flat but diverges outward from the third internal engaging surface 69 and imaginary central axis 59 at an angle A4 which is about 13 degrees. In preferred embodiments of the present invention, the fourth internal engaging surface 71 diverges outward from the third internal engaging surface 69 at an angle within the range of 3 through 18 degrees. The angle could be slightly more or less but is preferably within that range. The fourth internal engaging surface 71 does not have to be flat, but could also be slightly arcuate.

In many preferred embodiments of the present invention the first internal engaging surface 63 is longer than the third internal engaging surface 69 which is longer than the second internal engaging surface 65.

In this embodiment of the present invention shown in FIG. 4, there is also a fifth internal engaging surface 73 which provides the wrench head with fastener tip engagement when the wrench head cannot be positioned flat against the surface surrounding the bolt head, nut or fastener. The fifth internal engaging surface 73 which is substantially parallel to the first internal engaging surface 63 can also provide a user with the ability to feel and confirm wrench size to fastener. It should be noted that the fifth internal engaging surface 73 is not considered a principle internal engaging surface as defined herein above, because the fifth internal engaging surface does not actually engage and interact with the fastener under torque, during normal operation.

Figure 5:
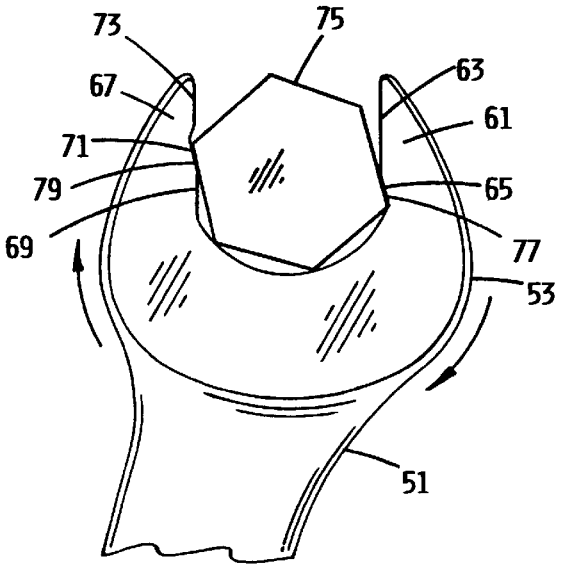
FIG. 5 shows the open end wrench of FIG. 4 with the wrench head turning clockwise, tightening a hexagonal fastener; and, FIG. 6 shows the open end wrench of FIGS. 4 and 5 flipped over, turning counter-clockwise and loosening a hexagonal fastener; and, FIG. 7 shows a top plan, cut view of a preferred embodiment of the present invention open end wrench.

FIG. 5 shows the open end wrench of FIG. 4 with wrench head 53 turning clockwise, tightening hexagonal fastener 75. Wrench head 53 has internal engaging surfaces 65 and 71 interacting with fastener engaging surfaces 77 and 79 respectively. With jaws 61 and 67 of wrench head 53 slightly spread under torque, internal engaging surface 65 achieves a substantial surface-to-surface contact with fastener engaging surface 77, and, internal engaging surface 71 achieves a substantial surface-to-surface contact with fastener engaging surface 79. This provides open end wrench 51 with superior strength and torque capacity without damaging or deforming fastener 75. To loosen fastener 75 wrench 51 is simply flipped over and turned in a counter-clockwise rotation as shown in the following FIG. 6.

Figure 6:
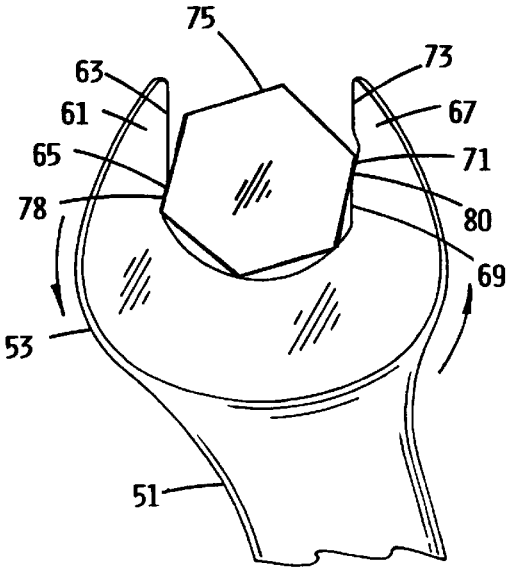

FIG. 6 shows the open end wrench of FIGS. 4 and 5 with wrench head 53 turning counter-clockwise, loosening hexagonal fastener 75. Wrench head 53 has internal engaging surfaces 65 and 71 interacting with fastener engaging surfaces 78 and 80 respectively. With jaws 61 and 67 of wrench head 53 slightly spread under torque, internal engaging surface 65 achieves a substantial surface-to-surface contact with fastener engaging surface 78, and, internal engaging surface 71 achieves a substantial surface-to-surface contact with fastener engaging surface 80. This provides open end wrench 51 with superior strength and torque capacity without damaging or deforming fastener 75.

Figure 7:
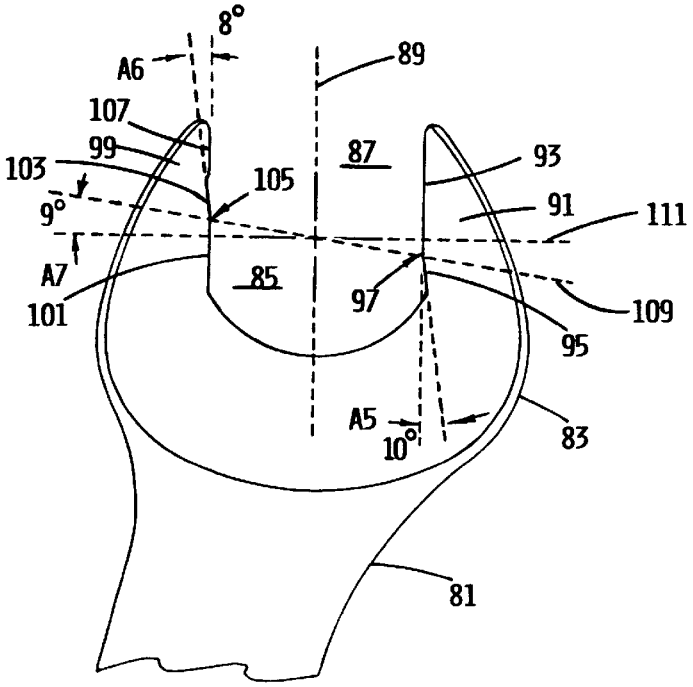

FIG. 7 shows a top plan, cut view of a preferred embodiment of the present invention with wrench 81 having wrench head 83 with orifice 85 and open end 87. Wrench head 83 is a one piece wrench head without any moving parts. Wrench head 83 has four principle internal engaging surfaces arranged asymmetrically around an imaginary central axis and center line 89 and imaginary perpendicular cross line 111. Again, the "principle" internal engaging surfaces are the internal engaging surfaces of the wrench head which are of the greatest importance and which actually engage and interact with the fastener under torque, during normal operation. A first jaw 91 has the first internal engaging surface 93 and the second internal engaging surface 95. The intersection point between the first and second internal engaging surfaces 93 and 95 respectively, is intersection point 97. The first internal engaging surface 93 is substantially flat and parallel to imaginary central axis 89 and positioned closer to the open end 87 of wrench head 83 than the second internal engaging surface 95. The second internal engaging surface 95 is substantially flat but diverges outward from the first internal engaging surface 93 and imaginary central axis 89 at an angle A5 which is about 10 degrees. In preferred embodiments of the present invention, the second internal engaging surface 95 diverges outward from the first internal engaging surface 93 at an angle within the range of 3 through 18 degrees. The angle could be slightly more or less but is preferably within that range. In more preferred embodiments of the present invention, the second internal engaging surface 95 diverges outward from the first internal engaging surface 93 at an angle within the range of 3 through 15 degrees. The second internal engaging surface 95 does not have to be flat, but could also be slightly arcuate. A second opposing jaw 99 has the third internal engaging surface 101 and the fourth internal engaging surface 103. The intersection point between the third and fourth internal engaging surfaces 101 and 103 respectively, is intersection point 105. The third internal engaging surface 101 is substantially flat and parallel to the imaginary central axis 89 and positioned farther away from the open end 87 of wrench head 83 than the fourth internal engaging surface 103. The fourth internal engaging surface 103 is substantially flat but diverges outward from the third internal engaging surface 101 and imaginary central axis 89 at an angle A6 which is about 8 degrees. In preferred embodiments of the present invention, the fourth internal engaging surface 103 diverges outward from the third internal engaging surface 101 at an angle within the range of 3 through 18 degrees. The angle could be slightly more or less but is preferably within that range. In more preferred embodiments of the present invention, the fourth internal engaging surface 103 diverges outward from the third internal engaging surface 101 at an angle within the range of 3 through 15 degrees. The fourth internal engaging surface 103 does not have to be flat, but could also be slightly arcuate. In this FIG. 7 which represents a preferred embodiment of the present invention, orifice 85 has four imaginary quadrants clearly formed by imaginary central axis 89 and imaginary, perpendicular crossline 111. In this view, second internal engaging surface 95 is positioned within the lower, right imaginary quadrant formed by imaginary lines 89 and 111, and, fourth internal engaging surface 103 is positioned within the upper, left imaginary quadrant also formed by imaginary lines 89 and 111. Accordingly, the second and fourth internal engaging surfaces are positioned within separate, diagonally opposing imaginary quadrants. Positioning the second and fourth internal engaging surfaces within separate, opposing quadrants is a fundamental feature of the present invention as shown in this figure (and every other figure herein). Also important, the second internal engaging surface 95 is positioned crosswise-opposite the third internal engaging surface 101 relative to imaginary, central axis 89, and, fourth internal engaging surface 103 is positioned crosswise-opposite the first internal engaging surface 93 relative to imaginary, central axis 89. Positioning the second and fourth internal engaging surfaces each crosswise-opposite an internal engaging surface that is substantially parallel to the central axis is another fundamental feature of the present invention as shown in this figure (and every other figure herein). Such combined arrangement helps to maximize the surface-to-surface contact of wrench to fastener, increase torque capability, reduce fastener deformation, and, most importantly, minimize the total free play arc between wrench and fastener which is an important object of the present invention as defined herein.

In many preferred embodiments of the present invention the first internal engaging surface 93 is longer than the third internal engaging surface 101 which is longer than the second internal engaging surfaces 95.

In this embodiment of the present invention shown in FIG. 7, there is also a fifth internal engaging surface 107 which provides the wrench head with fastener tip engagement when the wrench head cannot be positioned properly on the bolt head, nut or fastener. The fifth internal engaging surface 107 which is substantially parallel to the first internal engaging surface 93 can also provide a user with the ability to feel and confirm wrench size to fastener. It should be noted that the fifth internal engaging surface 107 is not considered a principle internal engaging surface as defined herein above, because the fifth internal engaging surface does not actually engage and interact with the fastener under torque, during normal operation.

In this FIG. 7, imaginary line 109 is formed by intersection points 97 and 105. Intersection point 97 is between and created by internal engaging surfaces 93 and 95; and, intersection point 105 is between and created by internal engaging surfaces 101 and 103. In this preferred embodiment of the present invention, imaginary line 109 is 9 degrees offset relative to imaginary line 111 which is perpendicular to imaginary central axis 89. In preferred embodiments of the present invention, the intersection point created between the first and second internal engaging surfaces and the third and fourth internal engaging surfaces together form an imaginary line which is within 15 degrees or less, of being perpendicular to the imaginary central axis. Imaginary line 109 could be offset slightly more or less but is preferably within that range. More preferably, imaginary line 109 is offset relative to imaginary perpendicular line 111 by an angle within the range of 3 through 15 degrees inclusive. Such an arrangement can further reduce the total free play arc between wrench and fastener.

Upon reading and understanding the specification of the present invention described above, modifications and alterations will become apparent to those skilled in the art. It is intended that all such modifications and alterations be included insofar as they come within the scope of the patent as claimed or the equivalence thereof.

What is claimed is:

1. A one piece, open end wrench head having an orifice with an imaginary central axis and an imaginary cross line together forming four imaginary quadrants; said orifice comprising four principle internal engaging surfaces with the first and second internal engaging surfaces being positioned on a first jaw and the third and fourth internal engaging surfaces being positioned on a second opposing jaw, said first internal engaging surface being substantially flat and substantially parallel to said imaginary central axis and positioned closer to the open end of said wrench head than said second internal engaging surface, said second internal engaging surface being substantially flat and diverging outward from said first internal engaging surface, said third internal engaging surface asymmetrically opposing said second internal engaging surface and being substantially flat and substantially parallel to said imaginary central axis and positioned farther away from the open end of said wrench head than said fourth internal engaging surface, said fourth internal engaging surface asymmetrically opposing said first internal engaging surface and being substantially flat and diverging outward from said third internal engaging surface, and, said second internal engaging surface and said fourth internal engaging surface each being positioned within separate, diagonally opposed quadrants.

2. A wrench head of claim 1, wherein there is a fifth internal engaging surface located on the second jaw of said wrench head, and said fifth internal engaging surface is substantially flat and substantially parallel to said imaginary central axis and positioned closer to the open end of said wrench head than said fourth internal engaging surface.

3. A wrench head of claim 1, wherein said first internal engaging surface is longer than said third internal engaging surface and said third internal engaging surface is longer than said second and fourth internal engaging surfaces.

4. A one piece, open end wrench head having an orifice with an imaginary central axis and an imaginary cross line together forming four imaginary quadrants; said orifice comprising four principle internal engaging surfaces with the first and second internal engaging surfaces being positioned on a first jaw and the third and fourth internal engaging surfaces being positioned on a second opposing jaw, said first internal engaging surface being substantially flat and substantially parallel to said imaginary central axis and positioned closer to the open end of said wrench head than said second internal engaging surface, said second internal engaging surface being substantially flat and diverging outward from said first internal engaging surface with an angle within the range of 3 through 15 degrees, said third internal engaging surface asymmetrically opposing said second internal engaging surface and being substantially flat and substantially parallel to said imaginary central axis and positioned farther away from the open end of said wrench head than said fourth internal engaging surface, said fourth internal engaging surface asymmetrically opposing said first internal engaging surface and being substantially flat and diverging outward from said third internal engaging surface with an angle within the range of 3 through 15 degrees, and, said second internal engaging surface and said fourth internal engaging surface each being positioned within separate, diagonally opposed quadrants.

5. A wrench head of claim 4, wherein there is a fifth internal engaging surface located on the second jaw of said wrench head, and said fifth internal engaging surface is substantially flat and substantially parallel to said imaginary central axis and positioned closer to the open end of said wrench head than said fourth internal engaging surface.

6. A wrench head of claim 4, wherein said first internal engaging surface is longer than said third internal engaging surface and said third internal engaging surface is longer than said second and fourth internal engaging surfaces.

7. A one piece, open end wrench head having an orifice with an imaginary central axis and an imaginary cross line together forming four imaginary quadrants; said orifice comprising four principle internal engaging surfaces with the first and second internal engaging surfaces being positioned on a first jaw and the third and fourth internal engaging surfaces being positioned on a second opposing jaw, said first internal engaging surface being substantially flat and substantially parallel to said imaginary central axis and positioned closer to the open end of said wrench head than said second internal engaging surface, said second internal engaging surface being substantially flat and diverging outward from said first internal engaging surface with an angle within the range of 3 through 15 degrees and being positioned crosswise-opposing said third internal engaging surface relative to said imaginary central axis, said third internal engaging surface being substantially flat and substantially parallel to said imaginary central axis and positioned farther away from the open end of said wrench head than said fourth internal engaging surface, said fourth internal engaging surface being substantially flat and diverging outward from said third internal engaging surface with an angle within the range of 3 through 15 degrees and being positioned crosswise-opposing said first internal engaging surface relative to said imaginary axis, and, said second internal engaging surface and said fourth internal engaging surface each being positioned within separate, diagonally opposed quadrants.

8. A wrench head of claim 7, wherein there is a fifth internal engaging surface located on the second jaw of said wrench head, and said fifth internal engaging surface is substantially flat and substantially parallel to said imaginary central axis and positioned closer to the open end of said wrench head than said fourth internal engaging surface.

9. A wrench head of claim 7, wherein said first internal engaging surface is longer than said third internal engaging surface and said third internal engaging surface is longer than said second and fourth internal engaging surfaces.

10. A wrench head of claim 7, wherein said second internal engaging surface diverges away from said imaginary center axis with an angle greater than that of said fourth internal engaging surface.

* * * * *